US005931338A

United States Patent [19]

Hoeting et al.

[11] Patent Number: 5,931,338

[45] Date of Patent: Aug. 3, 1999

[54] PERCUSSIVE DISPENSING TOY

[75] Inventors: Michael G. Hoeting; Sean T. Mullaney, both of Cincinnati, Ohio

[73] Assignee: Bang Zoom Design Inc., Cincinnati, Ohio

[21] Appl. No.: 08/979,681

[22] Filed: Nov. 26, 1997

[51] Int. Cl.[6] ..... A24F 15/04; G07F 11/00

[52] U.S. Cl. ..... 221/24; 446/280; 446/475

[58] Field of Search ..... 221/24, 191, 192, 221/193, 185, 260, 261, 271, 272; 446/168, 280, 429, 489

[56] References Cited

U.S. PATENT DOCUMENTS

| | | | |
|---|---|---|---|
| 616,495 | 12/1898 | Rouillion . | |
| 2,361,196 | 10/1944 | Gumb . | |
| 2,551,109 | 5/1951 | Fornary . | |
| 2,606,088 | 8/1952 | Leaf | 221/192 X |
| 3,120,079 | 2/1964 | Glass et al. | 221/24 X |
| 4,978,030 | 12/1990 | Morris et al. | 221/24 X |
| 5,046,984 | 9/1991 | Cane | 446/429 X |
| 5,449,174 | 9/1995 | Criner | 273/145 C |
| 5,651,475 | 7/1997 | Fenton | 221/24 |

*Primary Examiner*—William E. Terrell
*Assistant Examiner*—Gene O Crawford
*Attorney, Agent, or Firm*—Wood, Herron & Evans, L.L.P.

[57] ABSTRACT

A wheeled dispenser capable of storing and dispensing one or more objects from the interior of the dispenser. The wheeled dispenser is generally in the shape of an automobile and has a body having a deflector spaced in front of an opening and a recessed portion to collect items inside the dispenser body. The dispenser body is supported by rotatable wheels affixed to rotatable axles, one of which has a rotatable cog thereon. The rotatable cog strikes a deflector plate located beneath the dispenser body causing a striker to push objects inside the interior of the dispenser body off the deflector and through the opening and out into a collection bin where the user may remove the objects.

16 Claims, 1 Drawing Sheet

PERCUSSIVE DISPENSING TOY

FIELD OF INVENTION

This invention relates to a novelty-type dispensing toy.

BACKGROUND OF THE INVENTION

Candy dispensers are well know. Most of them are coin operated and stationary. In order to dispense one or more pieces of candy from a coin operated candy dispensing machine one must put a coin in the machine and turn a lever in order to open an opening in the machine and cause one or more pieces of candy to pass downwardly through a chute to the recipient standing in front of the machine.

The prior art also includes mobile candy dispensing machines, which may be more desirable than stationary, non-mobile candy dispensing machines, especially for children. A mobile candy dispenser which further functions as a toy may hold more appeal for children of younger ages than a conventional coin operated candy dispensing machine. In addition, a toy candy dispenser which is in the shape of an object known to the child, such as an animal, may be even more appealing to the child.

One such type of candy dispensing toy is disclosed in U.S. Pat. No. 2,361,196. This patent discloses a wheeled dispensing toy in the shape of a rabbit. The toy rabbit comprises two pivotally inter-connected pieces. The rear piece has a cavity or hopper adapted to hold a plurality of pieces of candy. The front piece of the toy rabbit is supported by a small wheel and the rear piece of the toy rabbit is supported by a larger wheel. The rear wheel has a dispensing notch therein. As the rear wheel rotates along a supporting surface, the dispensing notch passes the bottom of the hopper of the rear piece of the rabbit. A piece of candy, such as a chocolate egg, passes into the dispensing notch in the rear wheel and, upon further rotation of the rear wheel, is deposited on the ground or supporting surface as the dispensing notch passes the ground. Thus, the toy rabbit which is the subject of this patent is adapted to dispense one piece of candy at a time as the toy rabbit is wheeled along the floor or supporting surface. One drawback to such a dispensing apparatus is that only one piece of candy may be dispensed upon each rotation of the wheel and the dispensed item is deposited on the ground where it may be stepped on or otherwise contaminated.

Several other patents disclose wheeled toys which are adapted for purposes other than dispensing candy, and which utilize the rotation of one or more of the wheels of the toy to cause a certain function to occur. In U.S. Pat. No. 2,551,109, the rotation of the wheels of a toy military tank causes one or more ball missiles to eject from an ejecting gun mounted on the top of the tank body. In U.S. Pat. No. 5,449,174, the rotation of one or more wheels of a rolling dice agitator game causes a cog to rotate and engage a spring platform which, when actuated, rolls a pair of dice inside a car-shaped toy.

It is an object of the invention to further improve upon the versatility of wheeled candy dispensing toys.

It is another object of the invention to enhance the functional characteristics of wheeled candy dispensing toys, to allow dispensing of multiple pieces of candy but in a manner which does not leave the candy deposited on the ground.

SUMMARY OF THE INVENTION

The present invention achieves the above-stated objects via a wheeled dispenser in the shape of a vehicle, with a hollow interior, an internal deflector, an external collection bin and an opening therebetween. A pivotal window allows selective opening and closing of the opening. A striker structure cooperates with the wheels and the body so that, upon rotation of the wheels, items stored in the interior of the body are propelled upwardly, against the deflector, through the opening when selectively opened and into the collection bin. The substantially planar deflector is in the location of a front windshield on an automobile. The hollow dispenser body further has a recessed lower portion adapted to collect the objects inside the dispenser body, the recessed lower portion being located between two sets of wheels.

A rotatable cog is fixedly secured to one of two axles. Each axle extends between and is fixed to a set of rotatable wheels. The rotatable wheels support the dispenser body such that when the wheels are rotated, the axles rotate and the cog rotates on one of the axles. The cog has three extensions, each extension being capable of contacting the free end of a striker plate located underneath the dispenser body. The other end of the striker plate is fixed to a portion of the dispenser body so that upon the rotation of the cog, one of the cog extensions contacts and pushes downwardly the free end of the striker plate. This downward movement of the free end of the striker plate causes the striker plate to inherently spring upwardly upon the removal of the cog extension as the cog continues to rotate. A striker is integrally formed in the striker plate underneath the dispenser body. The function of the striker is to contact the recessed portion of the dispenser body thereby causing at least one of the objects located inside the hollow interior of the dispenser body to deflect off the deflector and out the opening of the dispenser body to a collection bin. The collection bin has a storage platform and is inherently part of the exterior surface of the dispenser body. The collection bin may be covered with a removable cab. The cab may be removed so that the individual playing with the toy may grab one or more of the objects which have been ejected from inside the dispenser body to the collection bin.

A hinged window is secured to the top of the dispenser body and is adapted to selectively cover the opening in the dispenser body so as to prevent objects from exiting the dispenser body even when the wheels are rotated. Thus, the opening in the dispenser body may be selectively opened and closed depending on whether the user wants to eject one or more objects (i.e. pieces of candy) from inside the dispenser body to the outer collection bin.

These and other objects and advantages of this invention will be apparent from the following description of the drawings.

DETAILED DESCRIPTION OF THE PREFERRED EMBODIMENT

Figure 1:
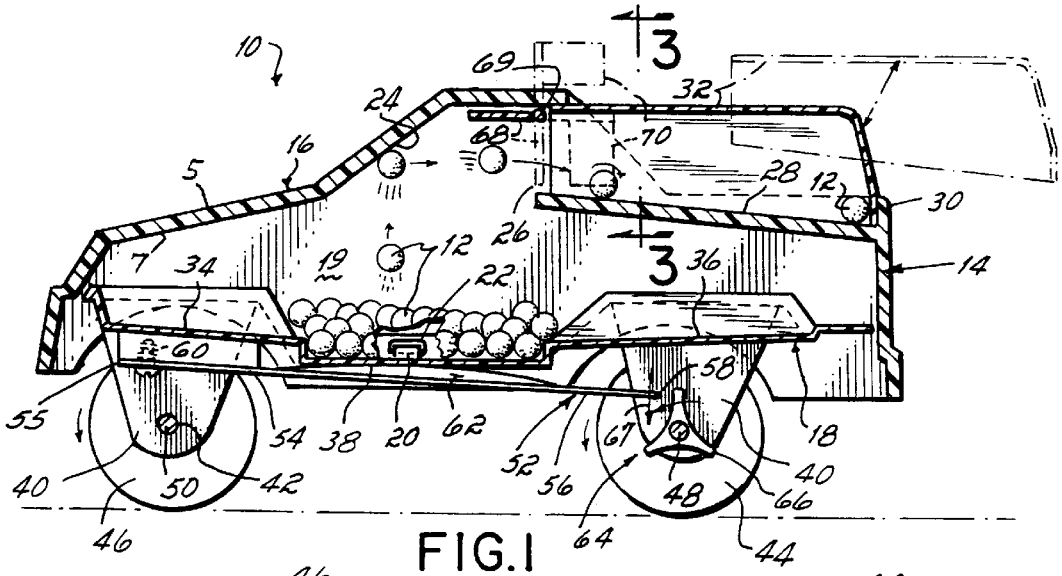
FIG. 1 is a longitudinal cross-sectional view of the wheeled dispenser of the present invention with the removable cab illustrated in two positions.

Referring to FIG. 1 of the drawings, there is illustrated a wheeled dispenser 10 capable of storing and dispensing one or more objects 12 from inside the dispenser body 14 to a collection bin 29. The dispenser body 14 has an external surface 5 and an internal surface 7. The internal surface 7 defines a hollow volume or hollow interior 19 which stores the items 12. The dispenser body 14 may be in the shape of an automobile or any other well known object or animal. The dispenser body 14 comprises a top piece 16 and a bottom piece 18. The top and bottom pieces 16, 18 may be snap-fit together through the use of two outwardly projecting tabs 20 integrally formed in the bottom piece 18 which are sized and adapted to fit through two holes 22 located in the top piece 16. When one desires to separate the top piece 16 from the bottom piece 18, one simply pulls the sides of the top piece 16 apart and pulls the bottom piece 18 away from the top piece 16 thus exposing the hollow interior 19 of the dispenser body. Alternatively, the top and bottom pieces 16, 18 may be secured together by other means such as by being screwed together.

The top piece 16 of the dispenser body 14 is generally in the shape of a top portion of an automobile and may have individual components of an automobile not shown in the drawings such as head lights and/or windows integrally formed or painted thereon. In the place of a front windshield of an automobile is a generally planar deflector 24 which is integrally formed as part of the top piece. Located rearwardly of the deflector 24 is an opening 26 which is generally rectangular shaped (see FIG. 3) but may take on other shapes as well. The rear of the top piece 16 of the dispenser body 14 comprises a collection bin 29 having a bottom storage platform 28 which extends downwardly from front to back and is generally planar. The storage platform 28 is sloped downwardly so as to cause the objects 12 which pass through the opening 26 and into the collection bin 29 to roll downwardly and abut against an upwardly projecting lip 30 which surrounds the storage platform 28. The lip 30 prevents objects from falling off the storage platform 28. As seen in FIG. 4, the collection bin 29 is defined by the external surface 5 of the dispenser body 14, resides well above the ground and is located outside the hollow interior 19 of the body 14. Thus, the objects 12 ejected from inside the dispenser body are collected at the rear of the collection bin 29.

A removable cap 32 is generally sized so as to fit just inside the lip 30 surrounding the storage platform 28 and cover the collection bin 29 in order to protect objects 12 resting in the collection bin 29. The removable cap 32 is a one piece injection molded or vacuum molded part as are the individual pieces of the dispenser body.

Turning now to the bottom piece 18 of the dispenser body 14, the bottom piece 18 of the dispenser body 14 is actually one piece of plastic. It has a generally planar downwardly sloping (from front to back) front portion 34 and a downwardly sloping (from back to front) back portion 36 and a recessed portion 38. The downwardly sloping front and back portions 34, 36 of the bottom piece 18 cause objects 12 to collect in the recessed portion 38. The recessed portion 38 is a generally rectangular area adapted to collect the individual balls or objects 12 which collect inside the interior 19 of the dispenser body 14. Although a generally rectangular recessed portion 38 is shown, the recessed portion 38 may take on other shapes as well. Extending downwardly from the bottom piece 18 of the dispenser body 14 are four individual axle supports 40. Each of the axle supports 40 has a hole 42 therein through which an axle passes.

The dispenser is supported by two rear wheels 44 and two front wheels 46 which are fixed on axles; the two rear wheels 44 being affixed to a rear axle 48 and the two front wheels 46 being affixed to a front axle 50. When the front wheels 46 rotate, the front axle 50 rotates; and likewise when the rear wheels 44 rotate, the rear axle 48 rotates.

Figure 2:
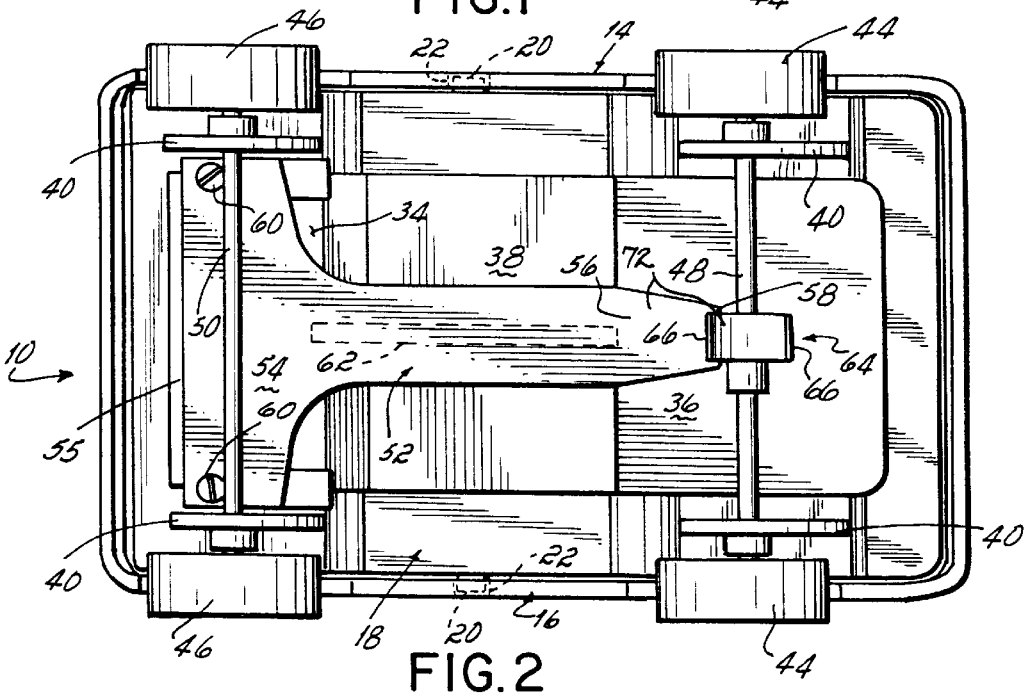
FIG. 2 is a bottom view of the wheeled dispenser of FIG. 1.

Turning now to FIG. 2, a propelling structure 72 comprising a striker plate 52 and a rotatable cog 64 is illustrated. The striker plate 52 is operatively connected to the dispenser body 14 and the rotatable cog 64 is operatively connected to the rear axle 48. The striker plate 52 is affixed to the lower surface of the bottom piece 18 of the dispenser body. The striker plate 52 comprises a front rectangular portion 54 and a generally tapered longitudinally extending rear portion 56 having a back or free end 58. The front portion 54 of the striker plate 52 is affixed to the bottom piece 18 of the dispenser body with two or more fasteners 60 illustrated in the drawings as being screws but which could be any other fastening means. This front portion 54 of the striker plate 52 therefore has a fixed front end 55. The back or free end 58 of the striker plate is not affixed to anything and is free floating. Integrally formed in the striker plate is a striker 62 illustrated in a rectangular form in FIG. 2 but which may take on alternative forms as well. The striker 62 is secured to the top surface of the striker plate 52 and adapted to contact the recessed portion 38 of the bottom piece 18 of the dispenser body 14.

As best seen in FIG. 2, a rotatable cog 64 is affixed to the rear axle 48 between the two rear wheels 44. The rotatable cog 64 may alternatively be affixed directly to one of the wheels. The cog 64 is illustrated as being generally triangular-shaped (see FIG. 1) with three cog extensions 66 but may have alternative configurations as well. The cog extensions 66 extend outwardly from the rear axle 48 and are adapted to contact the free end 58 of the striker plate 52.

In operation, as the rear wheels 44 are rotated counterclockwise as seen in FIG. 1, the cog extensions 66 contact and push downwardly the free end 58 of the striker plate 52 in the direction of arrow 67 (see FIG. 1). When the cog extension 66 becomes removed from the free end 58 of the striker plate 52, the striker plate 52 inherently springs upwardly causing the striker 62 to strike the recessed portion 38 of the bottom piece 18 of the dispenser body 14. Upon the recessed portion 38 of the dispenser body 14 being struck, one or more of the objects 12 inside the recessed portion 38 is driven upwardly, contacts the deflector 24 and is deflected through the opening 26 into the collection bin 29 where it may be easily removed by the user. Thus, simply by wheeling the dispenser along the ground or supporting surface, the rotatable cog 64 causes multiple objects 12 inside the dispenser body 14 to become deflected through an opening 26 in the dispenser body and out into a collection bin 29 where they may be easily removed by the user. Typically, the objects inside the dispenser body are pieces of candy but may be other objects as well.

Figure 3:
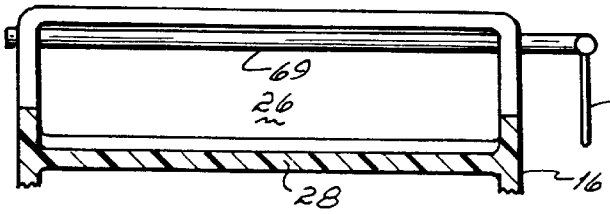
FIG. 3 is a view taken along the lines 3—3 of FIG. 1, the cab being removed for clarity.
Figure 4:
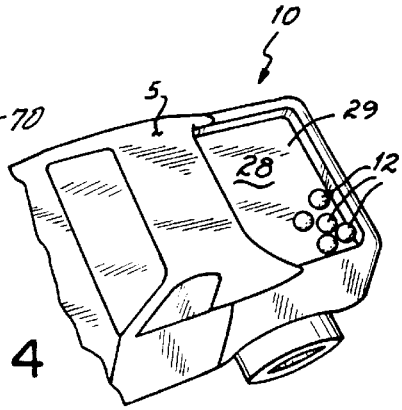
FIG. 4 is a perspective view of the wheeled dispenser of FIG. 1.

Referring to FIGS. 1 and 3, the generally rectangular opening 26 may be selectively closed by a hinged window 68 fixedly secured to a rod 69. The rod 69 may be operatively connected to a lever arm 70. In order to open and close the opening 26 with the hinged window 68, all the operator does is manually move the lever arm 70, so the lever arm 70 is either up or down. When the lever arm 70 is up as shown in solid lines in FIG. 1, the hinged window 68 is down closing the opening 26. Conversely , when the lever arm 70 is down (see FIG. 3 and dashed lines of FIG. 1), the opening 26 is open and objects may be projected through the opening 26 from the interior 19 of the dispenser body 14 into the collection bin 29. The lever arm 70 may take the form of a flag as illustrated or other forms not illustrated.

Thus, applicants have invented a simple wheeled dispenser toy adapted to dispense one or more objects from the interior of a toy simply by rotating the wheels of the toy.

While we have described only one preferred embodiment of the wheeled dispenser of the present invention, persons skilled in the art will appreciate changes and modifications which may be made without departing from the invention of this application. Therefore, we intend to be limited only by the scope of the following claims.

What is claimed:

1. A wheeled dispenser comprising:

a body having an external surface and an internal surface defining a hollow volume, the internal surface including a deflector spaced forwardly of a collection bin defined by the external surface and located outside the hollow volume, the body having an opening residing between the deflector and the collection bin;

a rotatable support rotatably mounted underneath the body; and a propelling structure operatively connected to the body and the rotatable support, the propelling structure including a striker plate which, upon rotation of the rotatable support relative to the body is adapted to strike the body and propel upwardly an item in the body, whereby the item deflects off the deflector, through the opening and into the collection bin.

2. The wheeled dispenser of claim 1 wherein the external surface of the body is in the shape of an automobile.

3. The wheeled dispenser of claim 1 wherein said propelling structure includes a rotatable cog secured to the rotatable support.

4. The wheeled dispenser of claim 3 wherein the striker plate has a front end and a rear end, one of said ends being fixed to a portion of the dispenser body, the striker plate being located underneath said dispenser body.

5. The wheeled dispenser of claim 4 wherein the striker plate is capable of springing upwardly after being contacted by the rotatable cog causing the striker plate to contact the external surface of the body.

6. The wheeled dispenser of claim 1 further comprising a hinged window secured to said body adapted to selectively open and close said opening.

7. The wheeled dispenser of claim 1 further comprising a removable cap adapted to cover the collection bin.

8. A wheeled dispenser comprising:

a body having an external surface and an internal surface defining a hollow interior, the internal surface including a deflector spaced forwardly of a collection bin defined by the external surface of the body, the body having an opening located between the deflector and the collection bin;

a pair of rotatable wheels fixed to a rotatable axle, the rotatable axle being supported by the body, a propelling structure operatively connected to the body and the rotatable axle, the propelling structure including a striker plate which, upon the rotation of the rotatable axle relative to the body is adapted to strike and propel upwardly an item located inside the hollow interior of the body whereby the item deflects off the deflector, through the opening and into the collection bin.

9. The wheeled dispenser of claim 8 wherein the external surface of the body is in the shape of an automobile.

10. The wheeled dispenser of claim 8 further comprising a hinged window secured to said body adapted to selectively open and close said opening.

11. The wheeled dispenser of claim 8 further comprising a removable cap adapted to cover said collection bin.

12. The wheeled dispenser of claim 8 wherein said propelling structure further includes a rotatable cog secured to the rotatable axle between the rotatable wheels.

13. The wheeled dispenser of claim 12 wherein the striker plate has a fixed end secured to the body and a free end such that upon the rotation of the wheels, the cog strikes the free end of the striker plate causing the striker plate to strike the external surface of the body.

14. A wheeled dispenser comprising:

a body having an external surface and an internal surface defining a hollow interior, the internal surface including a deflector spaced forwardly of a collection bin defined by the external surface of the body, the body having an opening residing between the deflector and the collection bin and a recessed portion adapted to collect items in the hollow interior of the body, a rotatable support rotatably mounted underneath the body, a propelling structure operatively connected to the body and the rotatable support, the propelling structure comprising a rotatable cog secured to the rotatable support and a striker plate which, upon rotation of the rotatable support relative to the body, is adapted to contact the recessed portion of the body whereby an item located inside the hollow interior of the body is propelled upwardly, deflected off the deflector, through the opening and into the collection bin.

15. The wheeled dispenser of claim 14 further comprising a window secured to said dispenser body capable of selectively opening and closing said opening.

16. The wheeled dispenser of claim 14 further comprising a removable cap adapted to cover said collection bin.

* * * * *